US011284692B2

(12) United States Patent
Simon et al.

(10) Patent No.: US 11,284,692 B2
(45) Date of Patent: Mar. 29, 2022

(54) CARRYING CASE WITH COMBINATION LOCK METHOD AND APPARATUS

(71) Applicants: Shonna Marie Simon, Rahway, NJ (US); Sydney Weiss, Atlanta, GA (US)

(72) Inventors: Shonna Marie Simon, Rahway, NJ (US); Sydney Weiss, Atlanta, GA (US)

( * ) Notice: Subject to any disclaimer, the term of this patent is extended or adjusted under 35 U.S.C. 154(b) by 0 days.

(21) Appl. No.: 16/940,096

(22) Filed: Jul. 27, 2020

(65) Prior Publication Data

US 2022/0022616 A1 Jan. 27, 2022

(51) Int. Cl.

| | |
|---|---|
| ***A45C 13/18*** | (2006.01) |
| ***A45C 11/20*** | (2006.01) |
| ***A45C 13/10*** | (2006.01) |
| ***E05B 37/00*** | (2006.01) |
| ***E05B 65/52*** | (2006.01) |
| ***B65D 81/38*** | (2006.01) |

(52) U.S. Cl.

CPC ..... *A45C 13/18* (2013.01); *A45C 11/20* (2013.01); *A45C 13/103* (2013.01); *B65D 81/3825* (2013.01); *E05B 37/0096* (2013.01); *E05B 65/5238* (2013.01); *E05Y 2900/602* (2013.01)

(58) Field of Classification Search

CPC ..... A45C 13/18; A45C 11/20; A45C 13/103; B65D 81/3825; E05B 37/0096; E05B 65/5238; E05B 65/523; E05B 17/145; E05Y 2900/602

USPC ..... 190/118, 119; 70/71, 304, 312; 220/592.2

See application file for complete search history.

(56) References Cited

U.S. PATENT DOCUMENTS

| | | | | |
|---|---|---|---|---|
| 3,411,330 | A * | 11/1968 | Atkinson | E05B 37/12 70/71 |
| 3,776,006 | A * | 12/1973 | Atkinson | E05B 37/12 70/74 |
| D364,320 | S * | 11/1995 | Sipe | D3/294 |
| 6,513,349 | B1 * | 2/2003 | Miao | A45C 13/42 206/38 |
| 7,334,684 | B1 * | 2/2008 | Fontanilla | A45C 11/20 190/110 |
| 2009/0294455 | A1 * | 12/2009 | Pruchnicki | B65D 81/3816 220/592.2 |

(Continued)

OTHER PUBLICATIONS www.vaultz.com, Jun. 25, 2020, "Vaultz-Locking Storage/Official Site".

(Continued)

*Primary Examiner* — Rafael A Ortiz
*Assistant Examiner* — Sanjidul Islam
(74) *Attorney, Agent, or Firm* — Walter J. Tencza, Jr.

(57) ABSTRACT

A carrying case or container having an box structure having a top opening and a lid configured to cover the top opening; and a locking mechanism having a first dial; wherein the locking mechanism is used to lock the lid to the open box structure so that the lid covers the opening of the box structure; wherein the box structure includes a first wall, a second wall, a third wall, a fourth wall, and a bottom member; wherein the first wall is parallel to the third wall, the second wall is parallel to the fourth wall, and the first wall is perpendicular to the second wall; and wherein the first dial is rotatably mounted to the first wall, so that the first dial rotates in a plane which is parallel to the first wall.

16 Claims, 10 Drawing Sheets

(56) References Cited

U.S. PATENT DOCUMENTS

| | | | | |
|---|---|---|---|---|
| 2012/0080350 | A1* | 4/2012 | Powell | E05B 39/00 206/528 |
| 2020/0141623 | A1* | 5/2020 | Jayasinhe | A45C 11/20 |

OTHER PUBLICATIONS www.lunchlocka.com, Jun. 25, 2020, "Lunch Locka—The Locking Lunch Bag".

* cited by examiner

CARRYING CASE WITH COMBINATION LOCK METHOD AND APPARATUS

FIELD OF THE INVENTION

This invention relates to devices for carrying cases.

BACKGROUND OF THE INVENTION

There are various carrying cases known in the art which have locking devices, such as combination locks.

SUMMARY OF THE INVENTION

One or more embodiments of the present invention pertain generally to devices for carrying cases. More specifically, one or more embodiments of the present invention relate to carrying cases for food and beverage storage. In at least one embodiment, a carrying case is provided which includes a locking mechanism to secure contents inside the carrying case. The contents of the carrying case may be retrieved once dials are aligned to proper values.

In at least one embodiment, the carrying case may include a locking mechanism. In at least one embodiment, a lid is fastened with a zipper and is secured with a rotary style mechanism located on the face (front) of the carrying case. In at least one embodiment, the construction of the carrying case may be lined with a rigid shell to support the locking mechanism.

One or more embodiments of the present invention provide an apparatus comprising: a container having an box structure having a top opening and a lid configured to cover the top opening; a locking mechanism having a first dial; wherein the locking mechanism is used to lock the lid to the open box structure so that the lid covers the opening of the box structure; wherein the box structure includes a first wall, a second wall, a third wall, a fourth wall, and a bottom member; wherein the first wall is parallel to the third wall, the second wall is parallel to the fourth wall, and the first wall is perpendicular to the second wall; and wherein the first dial is rotatably mounted to the first wall, so that the first dial rotates in a plane which is parallel to the first wall.

In at least one embodiment of the present invention the box structure is comprised of inner materials which are made of an insulation material, and outer materials which are made of a fabric material.

In at least one embodiment, of the present invention the locking mechanism includes a second dial, and a third dial; wherein the second dial is rotatably mounted to the first wall, so that the second dial rotates in a plane which is parallel to the first wall; and wherein the third dial is rotatably mounted to the first wall, so that the third dial rotates in a plane which is parallel to the first wall.

The apparatus may further include a first strap having a loop; and wherein the first strap is fixed to the lid. The first strap may be connected to a sliding member which slides with respect to the bottom member in order to change the apparatus from a closed state, in which the lid covers the opening of the box structure to an opened state in which the lid is not covering the opening of the box structure. T sliding member may be configured to be slid into a position which allows the lid to be pivoted from a closed state to an open state when a plurality of slots of a plurality of wheels within the box structure are aligned.

In at least one embodiment of the present invention, a method is provided which may include locking a lid to a box structure so that the lid covers a top opening of the box structure; wherein the lid is locked by a locking mechanism having a first dial; wherein the box structure includes a first wall, a second wall, a third wall, a fourth wall, and a bottom member; wherein the first wall is parallel to the third wall, the second wall is parallel to the fourth wall, and the first wall is perpendicular to the second wall; and wherein the first dial is rotatably mounted to the first wall, so that the first dial rotates in a plane which is parallel to the first wall. The method may operate with structures previously described.

DETAILED DESCRIPTION OF THE DRAWINGS

Figure 1:
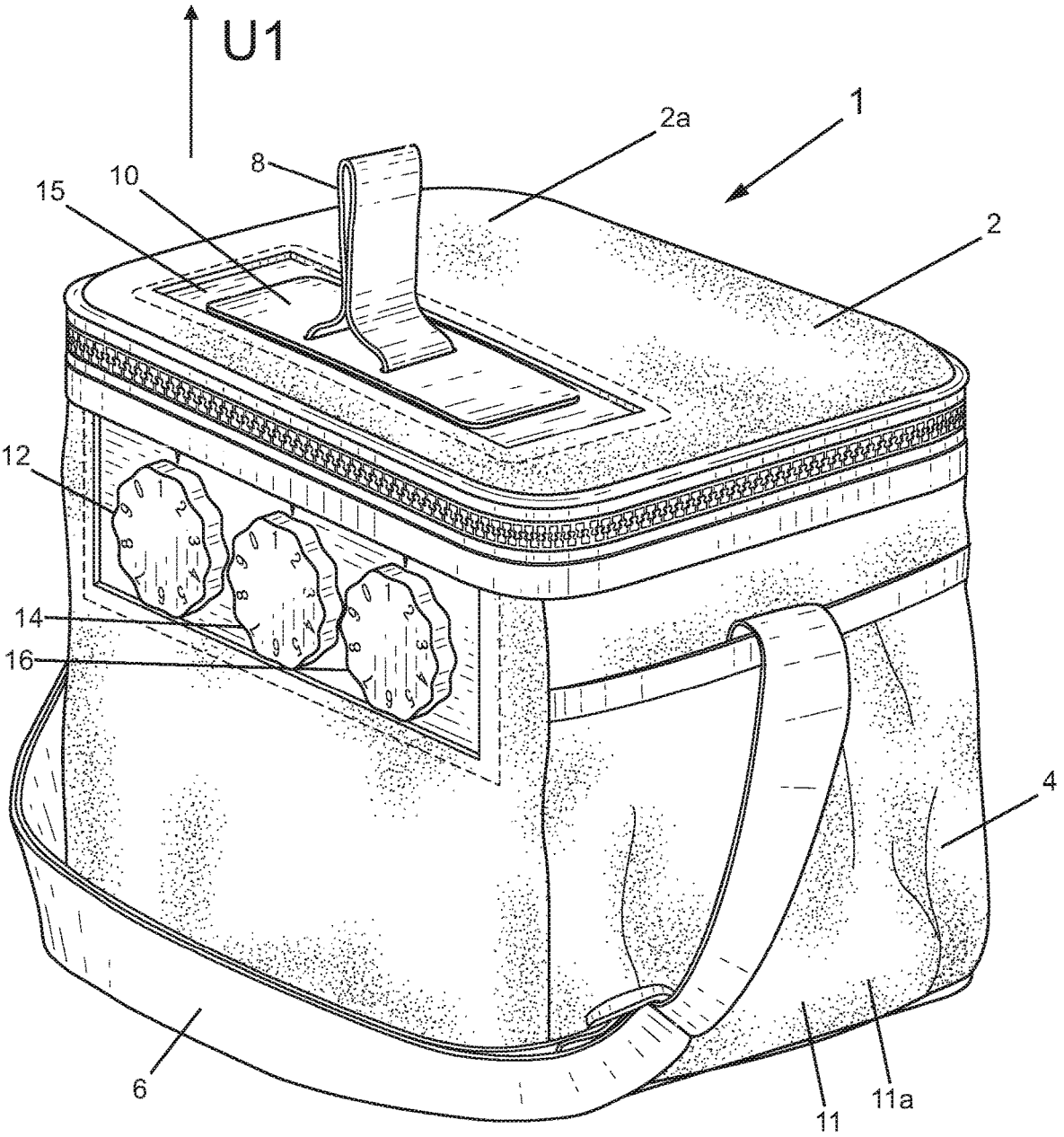
FIG. 1 is a front, right, and top perspective view of a carrying case with combination lock, in a closed state, in accordance with an embodiment of the present invention.
Figure 2:
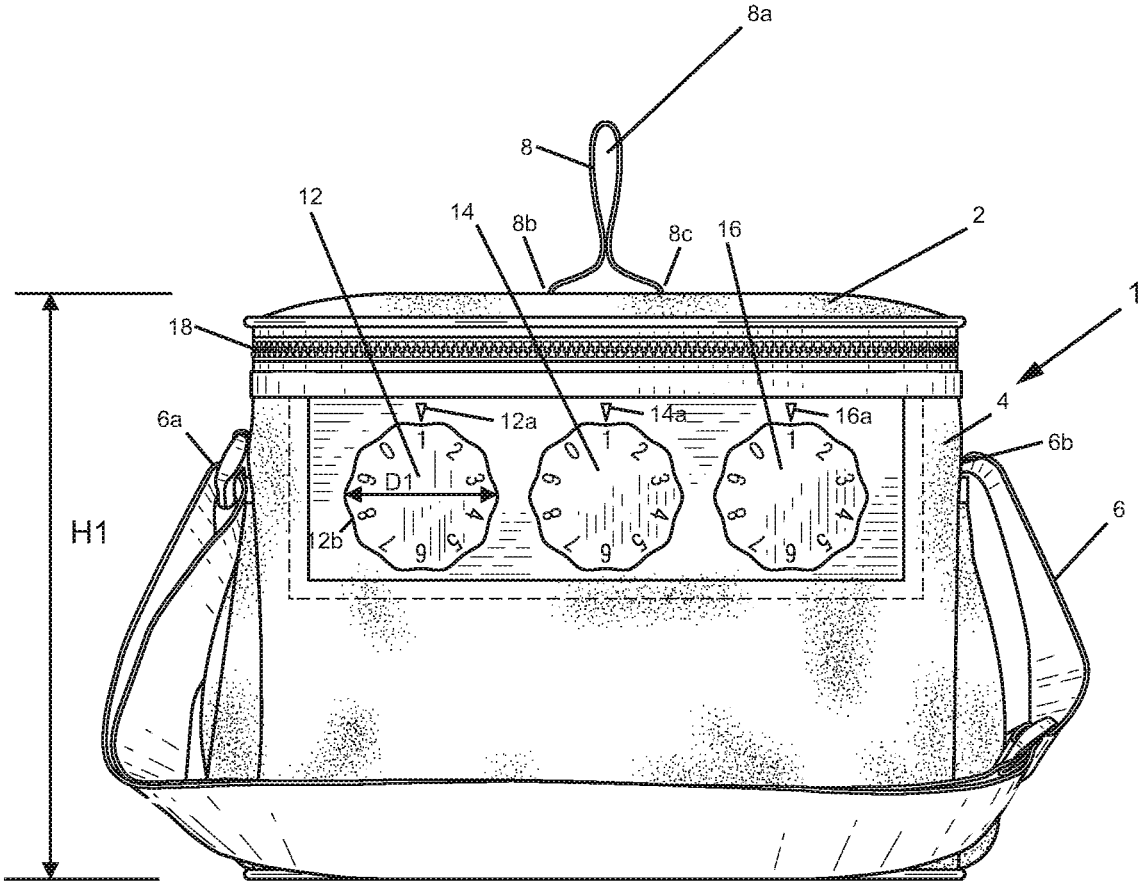
FIG. 2 is a front elevational view of the carrying case with combination lock of FIG. 1, in the closed state.
Figure 3:
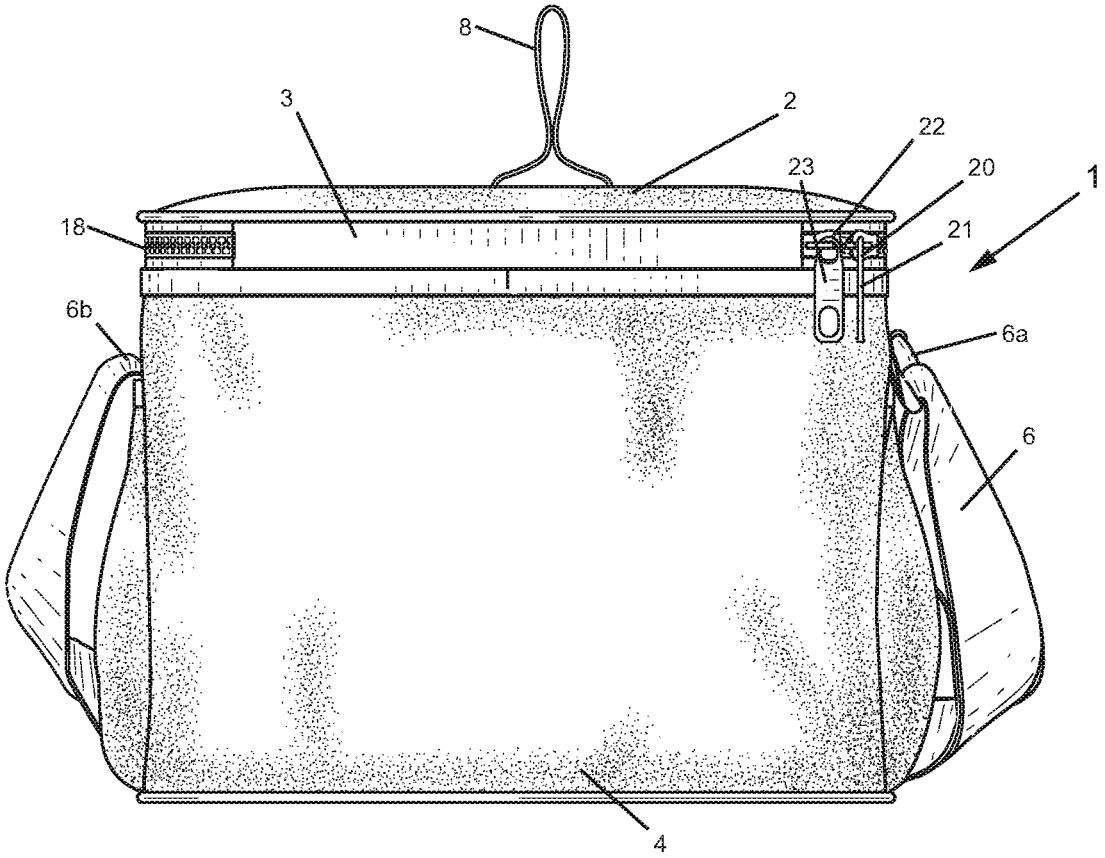
FIG. 3 is a rear elevational view of the carrying case with combination lock of FIG. 1, in the closed state.
Figure 4:
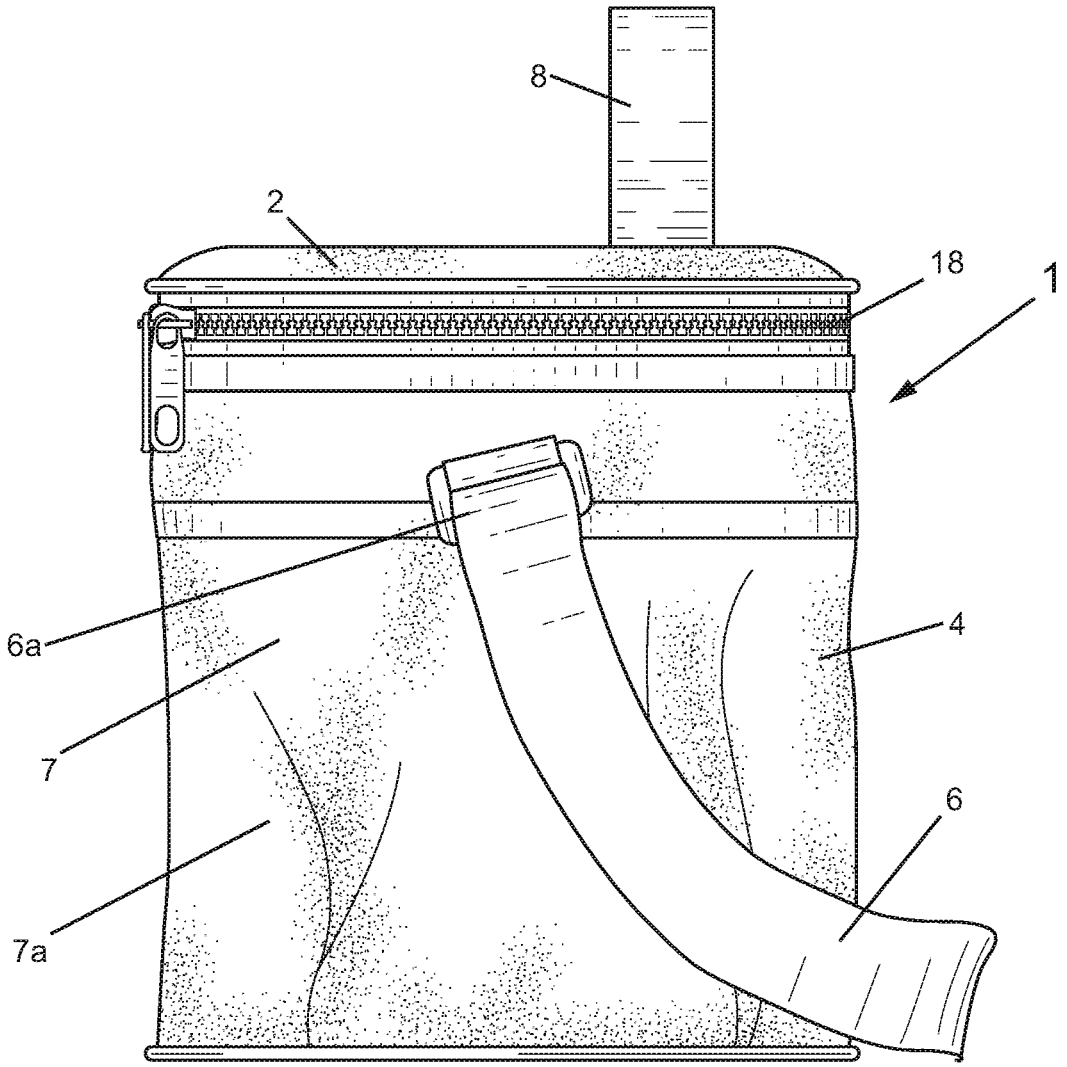
FIG. 4 is a left side elevational view of the carrying case with combination lock of FIG. 1, in the closed state.
Figure 5:
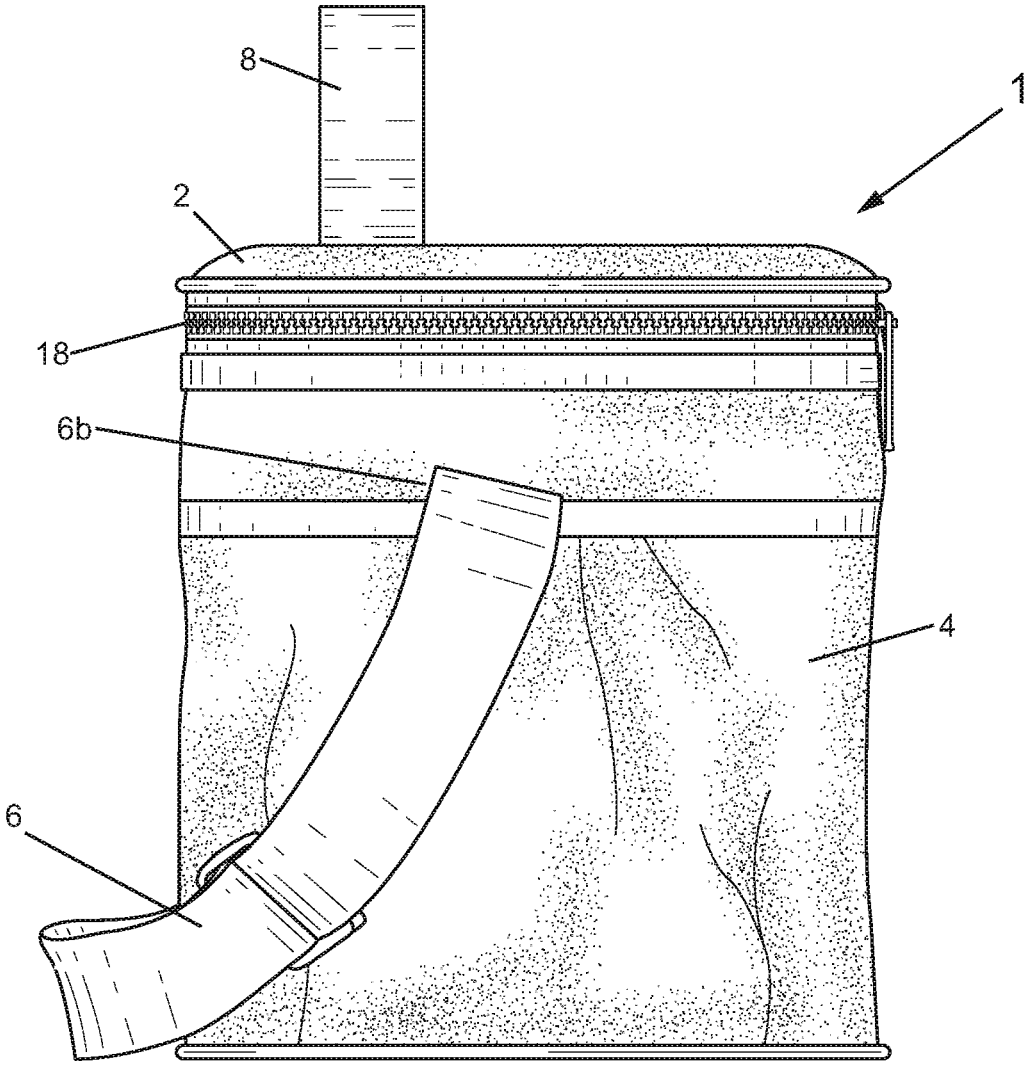
FIG. 5 is a right side elevational view of the carrying case with combination lock of FIG. 1.
Figure 6:
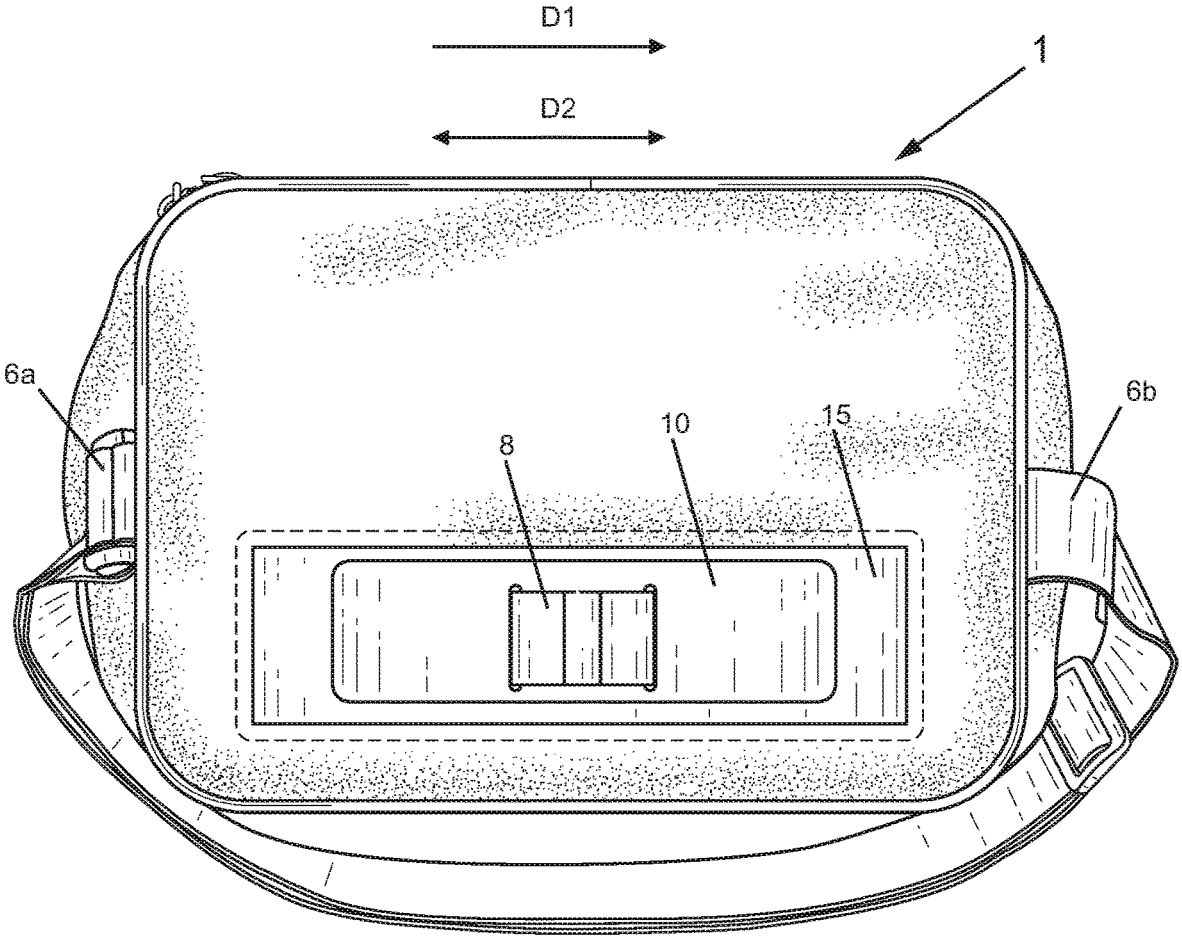
FIG. 6 is a top plan view of the carrying case with combination lock of FIG. 1, in the closed state.
Figure 7:
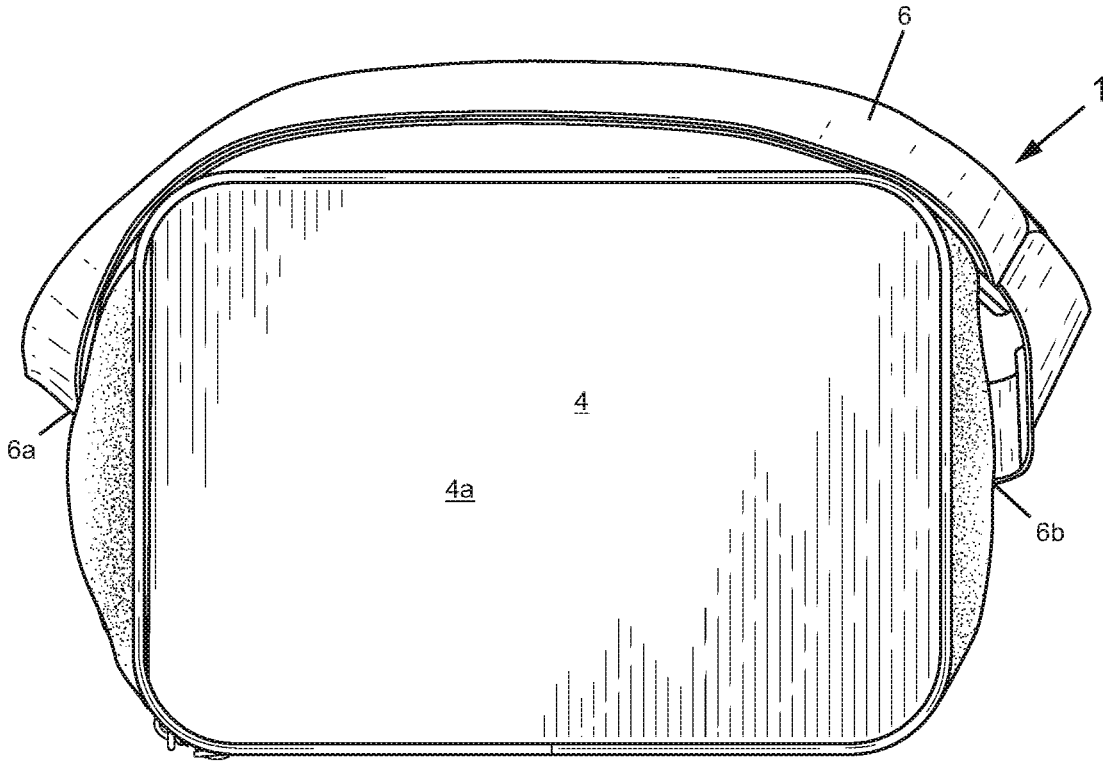
FIG. 7 is a bottom view of the carrying case with combination lock of FIG. 1, in the closed state.

FIG. 1 is a front, right, and top perspective view of a carrying case with combination lock 1 in accordance with the present invention. FIG. 2 is a front elevational view of the carrying case with combination lock 1 of FIG. 1. FIG. 3 is a rear elevational view of the carrying case with combination lock 1 of FIG. 1. FIG. 4 is a left side elevational view of the carrying case with combination lock 1 of FIG. 1. FIG. 5 is a right side elevational view of the carrying case with combination lock 1 of FIG. 1. FIG. 6 is a top plan view of the carrying case with combination lock 1 of FIG. 1. FIG. 7 is a bottom view of the carrying case with combination lock 1 of FIG. 1.

The carrying case with combination lock 1 includes a lid 2, a container or receptacle 4, a strap 6, a strap 8, a plate 10, a member 15, combination dials 12, 14, and 16, zipper teeth 18, zipper slider 20, zipper puller 21, zipper slider 22, and zipper puller 23.

The lid 2 is connected to the container 4 by a hinge or material 3. The lid 2, when unlocked with respect to the container 4, can be swung open and/or pivoted with respect to the container 4 by unzipping zipper teeth 18 by use of one or both of zipper slider 20 and zipper puller 21 and/or zipper slider 22 and zipper puller 23, and then swinging or pivoting the lid 2 from an orientation parallel or substantially parallel to bottom member 4*a* (shown in FIG. 7) to an orientation at an angle, perpendicular or substantially perpendicular to bottom member 4*a*.

The lid 2 may be locked, with respect to the container 4, in the state shown in FIG. 1. The lid 2 is configured to be unlocked by placing the dials 12, 14, and 16, in a state where a lock combination number for dials 12, 14, and 16, lines up with an arrow or triangle 12*a*, 14*a*, and 16*a*, respectively (shown in FIG. 2), and then by moving the strap 8 from the left side to the right side of carrying case with combination lock 1, to cause the plate 10 to slide in the same direction, when the combination of dials 12, 14, and 16 is a correct set combination, which may then allow the lid 2 to be swung open from the closed position of FIG. 1.

The strap 6 is connected at ends 6*a* and 6*b* to the outside of the container 4. The container 4 may have an inner chamber 13, shown by FIG. 8, in which various items can be stored.

Figure 8:
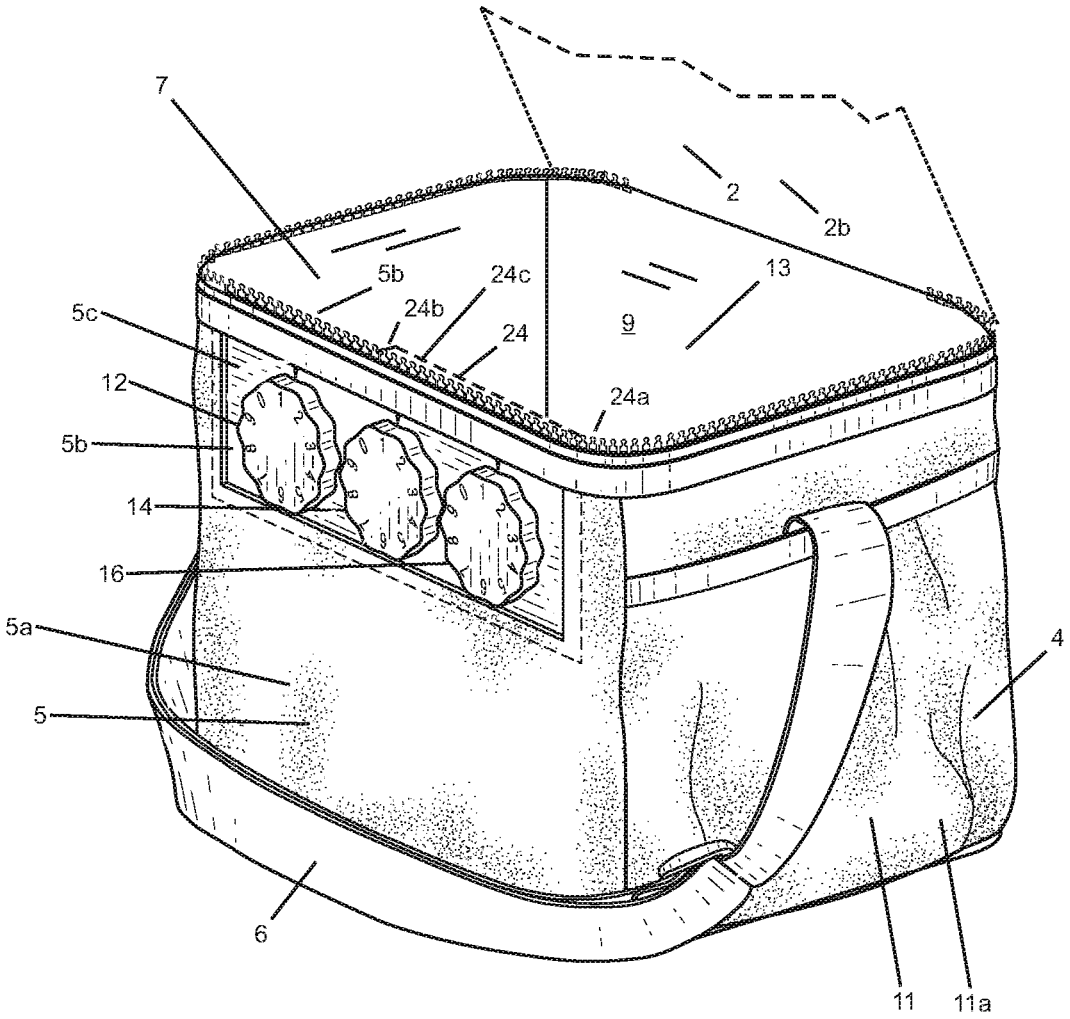
FIG. 8 is a front, right, and top perspective view of part of the carrying case with combination lock of FIG. 1, in an open state, along with dashed lines showing the location of various interior components, in accordance with an embodiment of the present invention.

FIG. 8 is a front, right, and top perspective view of part of the carrying case with combination lock 1 of FIG. 1, in an open state, along with dashed lines showing the location of various interior components, in accordance with an embodiment of the present invention. The dashed lines show the location of compartment or housing 24 against and attached to an interior surface 5*b*, which is opposite the exterior surface 5*a* of wall 5 of container 4. The container 4 has an inner chamber 13 which is bound by walls 5, 7, 9, and 11 shown in FIG. 8, and bottom member 4*a* shown in FIG. 7.

Figure 9A:
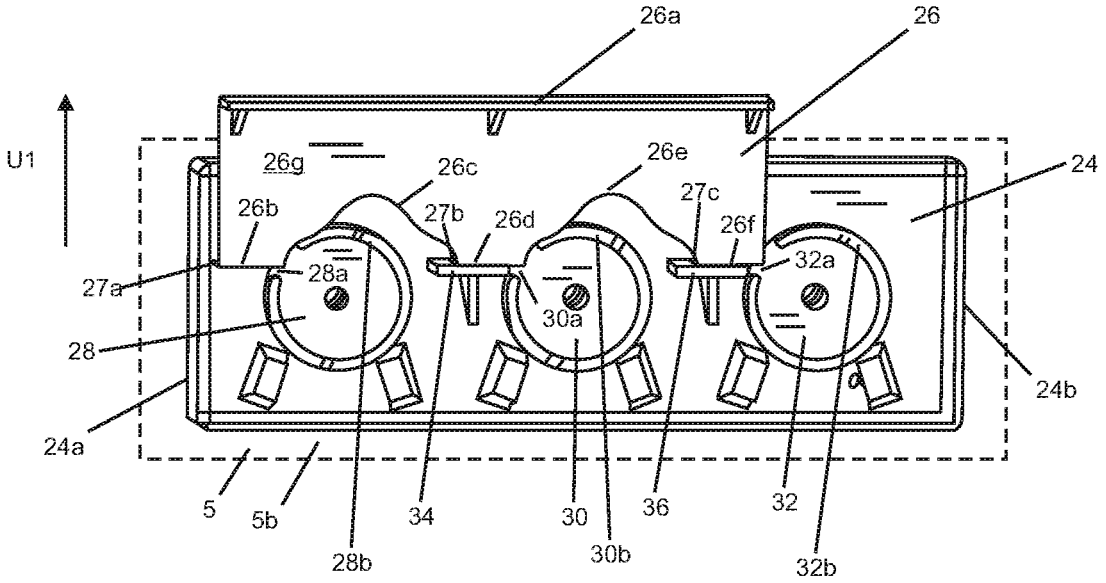
FIG. 9A is an interior view of a first plurality of interior components for use with the carrying case with combination lock of FIG. 1, with the first plurality of interior components in a first state.
Figure 9B:
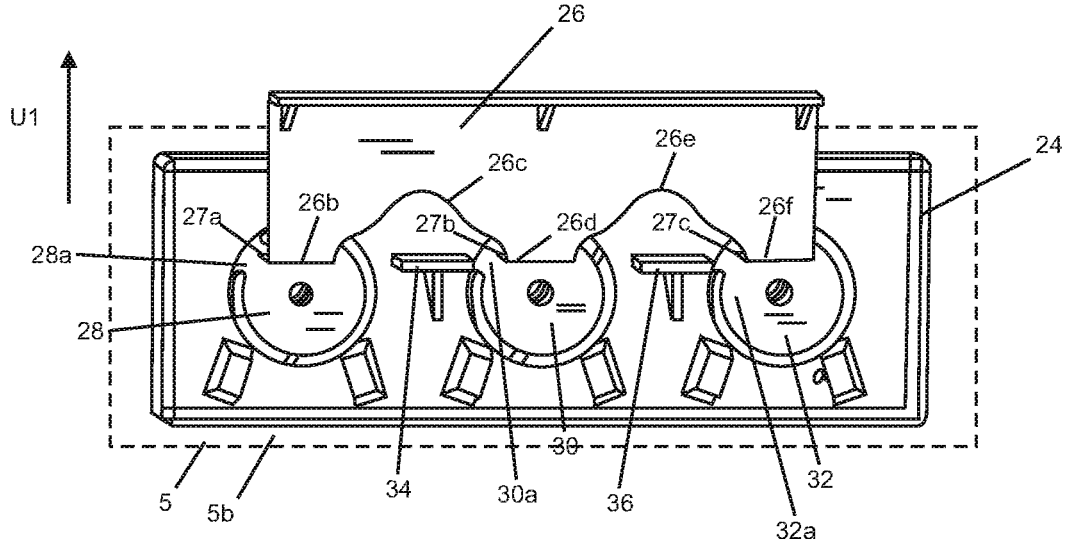
FIG. 9B is an interior view of the first plurality of interior components of FIG. 9A, with the first plurality of interior components in a second state.

FIG. 9A is an interior view of a first plurality of interior components for use with the carrying case with combination lock 1 of FIG. 1, with the first plurality of interior components in FIG. 9A in a first state. FIG. 9B is an interior view of the first plurality of interior components for use with the carrying case with combination lock 1 of FIG. 1, with the first plurality of interior components in a second state.

The components shown in FIGS. 9A-B include housing 24, shown by dashed lines in FIG. 8, which is attached to the interior surface 5*b* of the wall 5 of the container 4. Dashed lines in FIGS. 9A-B show the location of part of interior surface 5*b* of the wall 5.

Within the housing 24 are wheels 28, 30, and 32 which have slots 28*a*, 30*a*, and 32*a*, respectively. The wheels 28, 30, and 32 are turned or pivoted by turning dials 16, 14, and 12, respectively, shown in FIG. 1. The housing 24 has a side 24*a*, an opposing side 24*b* shown in FIGS. 9A-B, and a top opening or slot 24*c* shown in FIG. 10, and the location of which is shown in FIG. 8.

The components in FIGS. 9A-B also include member 26 which has a first ledge 26*a* or flange protruding away from the wall 5 and a second ledge or flange including members 27*a*, 27*b*, and 27*c* which protrude towards the wall 5. The member 26 may include a flat portion, plate, or member 26*g*. The ledges or flanges 26*a* and 27*a-c* may be substantially perpendicular to the portion 26*g*. Components 34 and 36 are shown in FIGS. 9A-B and in FIG. 10.

The member 26 is fixed to the member 10 shown in FIG. 1. The member 10 can be slid in the directions D1 and D2, as shown in FIG. 6, within limits, to cause the member 26 to be in the first state of FIG. 9A or in the second state of FIG. 9B or in various states in between the first state and the second state, when the slots 28*a*, 30*a*, and 32*a* are oriented as shown in FIGS. 9A-9B, with respect to the housing 24. When the slots 28*a*, 30*a*, and 32 are in the orientation shown in FIGS. 9A-9B with respect to the housing 24, the member 26 can be moved back and forth in the directions D1 and D2.

In the first state of FIG. 9A, the lid 2 can be pivoted upwards from the closed state of FIG. 1 to the open state shown partially by FIG. 8. The flanges 27*a*, 27*b*, and 27*c*, shown in FIG. 9A are not prevented in the first state of FIG. 9A from being lifted upwards in the direction U1 shown in FIG. 9A by pulling strap 8 upwards in the direction U1, shown in FIG. 1. Pulling the strap 8 upwards in the direction U1, shown in FIG. 1, pulls member 10 upwards, which pulls member 26 upwards, which pulls lid 2 upwards to change from the closed state of FIG. 1 to the open state of FIG. 8.

In contrast, in the second state of FIG. 9B, the lid 2 cannot be pivoted upwards from the closed state of FIG. 1 to the open state shown partially by FIG. 8. In the second state of FIG. 9B, the flanges 27*a*, 27*b*, and 27*c*, are prevented by arcuate protrusions 28*b*, 30*b*, and 32*b*, respectively, shown in FIG. 9A from allowing the member 26 to be lifted upwards in the direction U1.

While in the second state of FIG. 9B, the wheels 28, 30, and 32 are configured to be rotated by turning dials 16, 14, and 12, respectively, shown in FIG. 1. When the wheels 28, 30, and 32 are turned the location and/or orientation of slots 28*a*, 30*a*, and 32 changes, and when one or more of the slots 28*a*, 30*a*, and 32*a* are not in the orientation of FIG. 9A, the member 26 cannot be slid back from the location shown in FIG. 9B to the location shown in FIG. 9A with respect to the housing 24, because arcuate or substantially circular flanges or protrusions 28*b*, 30*b*, and 32*b*, prevent the flanges 27*a*, 27*b*, and 27*c*, respectively, from moving outside of the perimeter of substantially circular flanges or protrusions 28*b*, 30*b*, and 32*b*, respectively.

In at least one embodiment, only when the dials 16, 14, and 12, show a particular set combination of three numbers, will the member 26 be able to slide back from the state of FIG. 9B to the state of FIG. 9A. The carrying case 1 is thus locked unless a specific combination of three numbers is applied to dials 16, 14, and 12.

Figure 10:
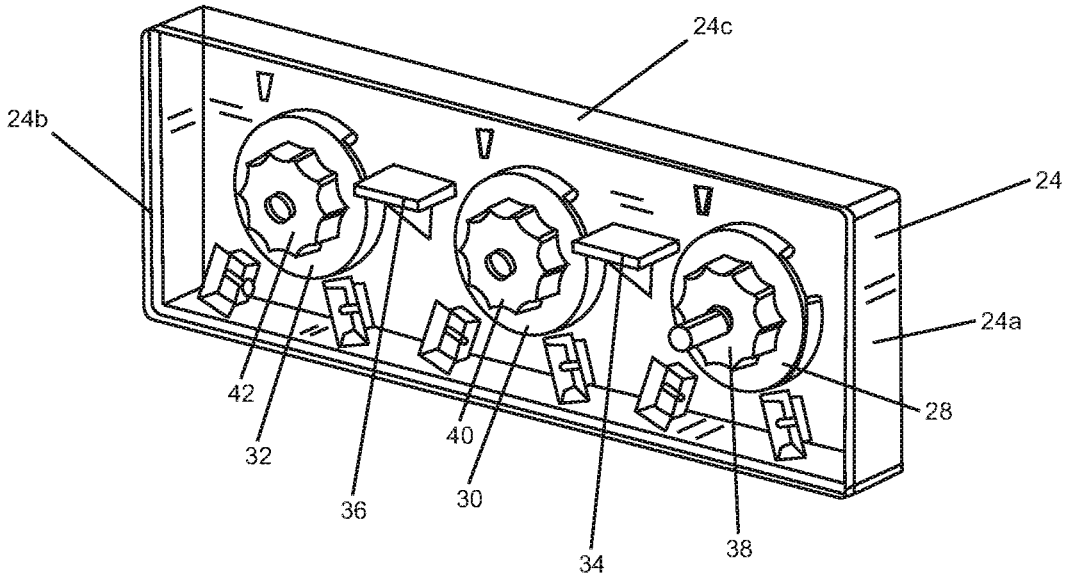
FIG. 10 is a front view of a second plurality of interior components for use with the carrying case with combination lock of FIG. 1.

FIG. 10 is a front view of a second plurality of interior components for use with the carrying case with combination lock 1 of FIG. 1. FIG. 10, shows gears 42, 40, and 38 which connect to dials 12, 14, and 16, respectively. The housing 24, with sides 24*a-b*, and opening 24*c* is also shown in FIG. 10.

Figure 11:
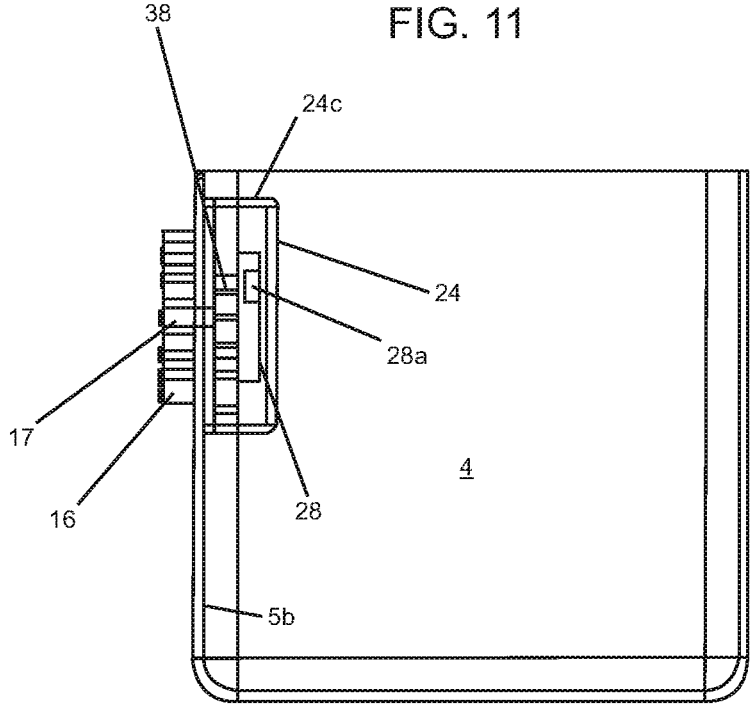
FIG. 11 is a side view of a third plurality of interior components for use with the carrying case with combination lock of FIG. 1.

FIG. 11 is a side view of a third plurality of interior components for use with the carrying case with combination lock 1 of FIG. 1. FIG. 11 shows the dial 16, the gear 38, and the wheel 28 with slot 28*a*. FIG. 11 also shows the location of wall 5 and the interior surface 5*b*.

In operation the dials 12, 14, and 16 are turned to a setting so that the slots 32*a*, 30*a*, and 28*a* are aligned as in FIG. 9A permitting the member 26 to be lifted and the lid 2 to be pivoted to the open state from FIG. 1 to FIG. 8.

Each of the walls 5, 7, 9, and 11 shown in FIG. 8 may have an interior surface or section which may be made of hard plastic (such as interior 5*b*) and/or insulated material and an exterior section which may be made of a cloth, textile, or fabric material. Similarly, the bottom 4*a* may be made of an interior surface or section may of a hard plastic or insulated material, and the exterior surface which may be made of a cloth, textile or fabric material. Similarly, the lid 2 may have an interior surface or section 2*b*, partially shown in FIG. 8, which may be made of hard plastic and/or an insulated material, and an exterior section 2*a*, shown in FIG. 1, which may be made of a cloth, textile or fabric material. The materials for the inner and outer sections as described for walls 5, 7, 9, 11, bottom 4*a*, and lid 2 are critical in at least one embodiment, to provide an insulated inner chamber 13 for food or drinks to be stored, and to provide outer coverings for walls 5, 7, 9, 11, bottom 4*a* and lid 2, which are aesthetically pleasing, can provide many different designs, and colors and which can be replaced by taking an inner hard container, comprised of inner sections of walls 5, 7, 9, 11, bottom 4*a*, and lid 2 out of the outer cloth, textile, or fabric materials of sections of walls 5, 7, 9, 11, bottom 4*a* and then the inner hard container can be placed in a different replacement out covering including different outer sections for walls 5, 7, 9, 11, bottom 4*a* and lid 2.

The outer section of wall 11 includes a pocket 11*a* shown in FIG. 1. The outer section of wall 7 include a pocket 7*a* shown in FIG. 4.

The apparatus 1, can be picked up or carried by the strap 6 which is attached at one end to the wall 11 above the pocket 11*a* (shown in FIG. 1), and is attached at an opposite end to the wall 7 above the pocket 7*a* (shown in FIG. 4). The strap 6 may be adjustable and is configured to be worn over a person's shoulder.

The apparatus 1 can also be picked up or carried by the strap 8, particularly when the apparatus 1 is in a locked, closed state as in FIG. 1, typically, when the dials 12, 14, and 16 have not been set to the combination of three numbers that permits pivoting open the lid 2 with respect to the container 4. It is critical in at least one embodiment that the strap 8 have a loop section with an opening 8*a*, which allows the apparatus 1 to be hung from a hook, such as a coat hook of a wall coat rack. The strap 8 may be attached to the lid 2 at end 8*a* and at opposing end 8*b* to sliding member 10.

In at least one embodiment, it is critical that the dials 12, 14, and 16 be large so that they can easily be manipulated and/or turned by an individual, such as a child. It is preferred that each of the dials 12, 14, and 16 have a diameter, D1, shown in FIG. 2, which is a substantial portion of the height H1 of the container 4 and/or the apparatus 1. It is critical in at least one embodiment, that the diameter D1, be about two inches, to provide large dials 12, 14, and 16 for turning by a child, a senior citizen, or anyone to make turning the dials easier, while the height, H1, of the container 4 (or apparatus 1, not including strap 8) may be about seven inches. Each of the dials 12, 14, and 16 is substantially circular in shape except for a plurality of indentations uniformly encircling each of the dials, such as indentation, 12*b*, which help a person, such as a child or senior citizen, in gripping the dials 12, 14, and 16.

In at least one embodiment, the outer material 5*a* of the wall 5 has an opening or large rectangular slot 5*c* shown in FIG. 8, to allow the dials 12, 14, and 16 to protrude out, and to be accessible, and to allow viewing of part of the inner material or section 5*b*. It is critical to have this opening 5*c* to avoid the dials 12, 14, and 16 from tearing the material of outer section 5*a* when the dials 12, 14, and 16 are turned, as they may be many times over the course of using the apparatus for a number of years.

In addition, it is critical in at least one embodiment, that dials 12, 14, and 16 rotate in a plane which is parallel to the wall 5, and inner section 5*b*, to which dials 12, 14, and 16 are attached as shown in FIG. 8. Having the dials 12, 14, and 16 rotate in this manner, along with the large size of the dials 12, 14, and 16, allow a human being to use all of the fingers of one hand to grip any one of the dials 12, 14, and 16, to easily turn any one of the dials 12, 14, and 16.

In at least one embodiment, as shown in FIG. 11, the dial 16 is rotatably mounted by a central pin or axle 17 to the inner section or wall 5*b* of the wall 5. The pin 17 passes through the center of the dial 16, and is connected to the center of the gear 38. When the dial 16 is rotated in a plane which is parallel to the wall or wall section 5*b*, the gear or member 38 rotates and the wheel 28 rotates, in planes parallel to the wall section 5*b*, and the orientation of the slot 28*a* with respect to wall section 5*b* and container 4, changes. The dials 12 and 14 are also rotatably mounted to the wall or wall section 5*b* in a similar or identical manner to the dial 16. Rotating the dials 16, 14, and 12 and thereby wheels 28, 30, and 32 into orientations as shown in FIGS. 9A and 9B allow the flanges 27*a*-27*c* to slide out from the positions of FIG. 9B, to the positions of FIG. 9A, through slots 28*a*, 30*a*, and 32*a*.

Although the invention has been described by reference to particular illustrative embodiments thereof, many changes and modifications of the invention may become apparent to those skilled in the art without departing from the spirit and scope of the invention. It is therefore intended to include within this patent all such changes and modifications as may reasonably and properly be included within the scope of the present invention's contribution to the art.

We claim:

1. An apparatus comprising:

a container having a box structure having a top opening and a lid configured to cover the top opening;

a locking mechanism having a first dial;

wherein the locking mechanism is used to lock the lid to the open box structure so that the lid covers the opening of the box structure;

wherein the box structure includes a first wall, a second wall, a third wall, a fourth wall, and a bottom member;

wherein the first wall is parallel to the third wall, the second wall is parallel to the fourth wall, and the first wall is perpendicular to the second wall;

wherein the first dial is rotatably mounted to the first wall, so that the first dial rotates in a plane which is parallel to the first wall;

wherein the first dial has a front surface, and wherein the front surface of the first dial extends along a diameter of the first dial; and wherein the first dial is rotatably mounted to the first wall by a first pin, such that the first pin does not pass through the front surface of the first dial, and so that the front surface is entirely exposed and is parallel to the first wall;

and further comprising a first strap having a loop; and wherein the first strap is fixed to the lid; and wherein the first strap is connected to a sliding member which slides with respect to the bottom member in order to change the apparatus from a closed state, in which the lid covers the opening of the box structure to an opened state in which the lid is not covering the opening of the box structure.

2. The apparatus of claim 1 wherein the box structure is comprised of inner materials which are made of an insulation material, and outer materials which are made of a fabric material.

3. The apparatus of claim 1 wherein the locking mechanism includes a second dial, and a third dial;

wherein the second dial is rotatably mounted to the first wall, so that the second dial rotates in a plane which is parallel to the first wall;

wherein the third dial is rotatably mounted to the first wall, so that the third dial rotates in a plane which is parallel to the first wall;

wherein the second dial has a front surface and wherein the front surface of the second dial extends along a diameter of the second dial;

wherein the second dial is rotatably mounted to the first wall by a second pin, such that the second pin does not pass through the front surface of the second dial, and so that the front surface of the second dial is entirely exposed and is parallel the first wall;

wherein the third dial has a front surface and wherein the front surface of the third dial extends along a diameter of the third dial; and wherein the third dial is rotatably mounted to the first wall by a third pin, such that the third pin does not pass through the front surface of the third dial, and so that the front surface of the third dial is entirely exposed and is parallel to the first wall.

4. The apparatus of claim 3 further comprising a sliding member which is configured to be slid into a position which allows the lid to be pivoted from a closed state to an open state when a plurality of slots of a plurality of wheels within the box structure are aligned.

5. The apparatus of claim 1 wherein the first wall includes an inner section to which the first dial is rotatably mounted, and an outer section, through which the first dial protrudes;

wherein the inner section of the first wall is made of hard plastic; and and wherein the outer section of the first wall is made of a fabric.

6. The apparatus of claim 1 wherein the front surface of the first dial is delimited by a three hundred and sixty degree outer periphery; and wherein the first dial is configured with respect to the first wall so that any part of the three hundred and sixty degree outer periphery of the first dial can be gripped using a person's fingers to rotate the first dial parallel to the first wall.

7. The apparatus of claim 3 wherein the front surface of the first dial is delimited by a three hundred and sixty degree outer periphery;

the front surface of the second dial is delimited by a three hundred and sixty degree outer periphery;

the front surface of the third dial is delimited by a three hundred and sixty degree outer periphery;

wherein the first dial is configured with respect to the first wall so that any part of the three hundred and sixty degree outer periphery of the first dial can be gripped using a person's fingers to rotate the first dial parallel to the first wall;

wherein the second dial is configured with respect to the first wall so that any part of the three hundred and sixty degree outer periphery of the second dial can be gripped using a person's fingers to rotate the second dial parallel to the first wall; and wherein the third dial is configured with respect to the first wall so that any part of the three hundred and sixty degree outer periphery of the third dial can be gripped using a person's fingers to rotate the third dial parallel to the first wall.

8. The apparatus of claim 3 wherein the first wall includes an inner section to which the first, second, and third dials are rotatably mounted, and an outer section;

wherein the inner section of the first wall is made of hard plastic;

wherein the outer section of the first wall is made of a fabric;

wherein there is an opening in the outer section, through which the first, second and third dials protrude and which allows the first, second and third dials to be rotated without contacting the outer section;

wherein the opening in the outer section allows the front surfaces of the first, second and third dials to be seen simultaneously;

wherein there is a corresponding mark on the first wall for each of the first, second, and third dials, so that there are three corresponding marks;

wherein each of the front surfaces of the first, second, and third dials has a plurality of numbers arranged in a circular pattern, so that only one of each of the plurality of numbers of each of the first, second, and third dials, is most closely adjacent a corresponding mark for each of the first, second, and third dials on the first wall; and wherein when each of the first, second, and third dials is rotated with respect to the first wall the number of the plurality of numbers for each of the first, second, and third dials, that is most closely adjacent the corresponding mark on the first wall changes.

9. A method comprising the steps of:

locking a lid to a box structure so that the lid covers a top opening of the box structure;

wherein the lid is locked by a locking mechanism having a first dial;

wherein the box structure includes a first wall, a second wall, a third wall, a fourth wall, and a bottom member;

wherein the first wall is parallel to the third wall, the second wall is parallel to the fourth wall, and the first wall is perpendicular to the second wall;

wherein the first dial is rotatably mounted to the first wall, so that the first dial rotates in a plane which is parallel to the first wall;

wherein the first dial has a front surface and wherein the front surface of the first dial extends along a diameter of the first dial; and wherein the first dial is rotatably mounted to the first wall by a first pin, such that the first pin does not pass through the front surface of the first dial, and so that the front surface is entirely exposed and is parallel to the first wall;

wherein a first strap having a loop is fixed to the lid; and wherein the first strap is connected to a sliding member which slides with respect to the bottom member in order to change the apparatus from a closed state, in which the lid covers the opening of the box structure to an opened state in which the lid is not covering the opening of the box structure.

10. The method of claim 9 wherein the box structure is comprised of inner materials which are made of an insulation material, and outer materials which are made of a fabric material.

11. The method of claim 9 wherein the locking mechanism includes a second dial, and a third dial;

wherein the second dial is rotatably mounted to the first wall, so that the second dial rotates in a plane which is parallel to the first wall;

wherein the third dial is rotatably mounted to the first wall, so that the third dial rotates in a plane which is parallel to the first wall;

wherein the second dial has a front surface and wherein the front surface of the second dial extends along a diameter of the second dial;

wherein the second dial is rotatably mounted to the first wall by a second pin, such that the second pin does not pass through the front surface of the second dial, and so that the front surface of the second dial is entirely exposed and is parallel to the first wall;

wherein the third dial has a front surface and wherein the front surface of the third dial extends along a diameter of the third dial; and wherein the third dial is rotatably mounted to the first wall by a third pin, such that the third pin does not pass through the front surface of the third dial, and so that the front surface of the third dial is entirely exposed and is parallel to the first wall.

12. The method of claim 9 wherein a sliding member is configured to be slid into a position which allows the lid to be pivoted from a closed state to an open state when a plurality of slots of a plurality of wheels within the box structure are aligned.

13. The method of claim 9 wherein the first wall includes an inner section to which the first dial is rotatably mounted, and an outer section, through which the first dial protrudes;

wherein the inner section of the first wall is made of hard plastic; and and wherein the outer section of the first wall is made of a fabric.

14. The method of claim 9 wherein the front surface of the first dial is delimited by a three hundred and sixty degree outer periphery; and wherein the first dial is configured with respect to the first wall so that any part of the three hundred and sixty degree outer periphery of the first dial can be gripped using a person's fingers to rotate the first dial parallel to the first wall.

15. The method of claim 11 wherein the front surface of the first dial is delimited by a three hundred and sixty degree outer periphery;

the front surface of the second dial is delimited by a three hundred and sixty degree outer periphery;

the front surface of the third dial is delimited by a three hundred and sixty degree outer periphery;

wherein the first dial is configured with respect to the first wall so that any part of the three hundred and sixty degree outer periphery of the first dial can be gripped using a person's fingers to rotate the first dial parallel to the first wall;

wherein the second dial is configured with respect to the first wall so that any part of the three hundred and sixty degree outer periphery of the second dial can be gripped using a person's fingers to rotate the second dial parallel to the first wall; and wherein the third dial is configured with respect to the first wall so that any part of the three hundred and sixty degree outer periphery of the third dial can be gripped using a person's fingers to rotate the third dial parallel to the first wall.

16. The method of claim 11 wherein the first wall includes an inner section to which the first, second, and third dials are rotatably mounted, and an outer section;

wherein the inner section of the first wall is made of hard plastic;

wherein the outer section of the first wall is made of a fabric;

wherein there is an opening in the outer section, through which the first, second and third dials protrude and which allows the first, second and third dials to be rotated without contacting the outer section;

wherein the opening in the outer section allows the front surfaces of the first, second and third dials to be seen simultaneously;

wherein there is a corresponding mark on the first wall for each of the first, second, and third dials, so that there are three corresponding marks;

wherein each of the front surfaces of the first, second, and third dials has a plurality of numbers arranged in a circular pattern, so that only one of each of the plurality of numbers of each of the first, second, and third dials, is most closely adjacent a corresponding mark for each of the first, second, and third dials on the first wall; and wherein when each of the first, second, and third dials is rotated with respect to the first wall the number of the plurality of numbers for each of the first, second, and third dials, that is most closely adjacent the corresponding mark on the first wall changes.

* * * * *